US006375707B1

(12) United States Patent
O'Donnell et al.

(10) Patent No.: US 6,375,707 B1
(45) Date of Patent: Apr. 23, 2002

(54) POINT BALL FOR BALL POINT PENS

(75) Inventors: Sylvie O'Donnell, Gresy sur Aix (FR); Jerome Cheynet, Shelby Township, MI (US); Björn Uhrenius, Vallentuna (SE)

(73) Assignee: Sandvik A.B., Sandviken (SE)

( * ) Notice: Subject to any disclaimer, the term of this patent is extended or adjusted under 35 U.S.C. 154(b) by 0 days.

(21) Appl. No.: 09/485,339

(22) PCT Filed: Dec. 22, 1998

(86) PCT No.: PCT/SE98/02433

§ 371 Date: May 15, 2000

§ 102(e) Date: May 15, 2000

(87) PCT Pub. No.: WO99/32681

PCT Pub. Date: Jul. 1, 1999

(30) Foreign Application Priority Data

Dec. 22, 1997 (SE) ..... 9704845

(51) Int. Cl.[7] ..... C22C 29/02
(52) U.S. Cl. ..... 75/241; 401/215
(58) Field of Search ..... 75/236, 240, 241; 401/215

(56) References Cited

U.S. PATENT DOCUMENTS 3,503,692 A 3/1970 Kubota et al.
3,660,050 A * 5/1972 Iler et al.
3,746,456 A 7/1973 Hill
3,993,446 A * 11/1976 Okawa
4,035,541 A * 7/1977 Smith et al. ..... 428/552
4,497,660 A * 2/1985 Lindholm
4,684,405 A * 8/1987 Kolaska et al.
4,843,039 A * 6/1989 Akesson et al.
4,963,183 A * 10/1990 Hong
5,305,840 A * 4/1994 Liang et al.
6,241,799 B1 * 6/2001 Galli ..... 75/236

FOREIGN PATENT DOCUMENTS

DE 35 11 220 A1 10/1986
EP 214679 A1 * 3/1987
GB 1 350 634 4/1974
JP 54-139815 A * 10/1979
WO WO 80/02569 11/1980

OTHER PUBLICATIONS

PCT International Search Report, PCT/SE98/02433, Apr. 26, 1999.

* cited by examiner

*Primary Examiner*—Roy King
*Assistant Examiner*—Harry D. Wilkins, III
(74) *Attorney, Agent, or Firm*—Burns, Doane, Swecker & Mathis, L.L.P.

(57) ABSTRACT

There is disclosed a cemented carbide containing tungsten carbide, titanium carbide, nickel, molybdenum and chromium. The composition of the materials provides a good resistance to corrosion as well as high hardness and wear resistance. These properties are particularly interesting for the manufacture of pen balls. Ball-point pen balls made with these materials will have steady writing characteristics over a long period of time. This material is particularly suitable when water-based inks are used, because these inks are far more common than oil-based inks.

4 Claims, 1 Drawing Sheet

POINT BALL FOR BALL POINT PENS

BACKGROUND OF THE INVENTION

The present invention relates to a ball-point in which is used a cemented carbide containing tungsten carbide, titanium carbide, nickel, molybdenum and chromium.

Some pen balls are used with water based inks. Such inks are corrosive and therefore the pen balls must be resistant to corrosion. The most severe corrosive situation occurs when the pen is stored and the ball is not in use. In that situation both crevice corrosion as well as galvanic corrosion might occur due to the different metals present in the ball and the seat. The thin space in between the ball and the seat is also unfavourable from a corrosion point of view, due to the difference of oxygen potentials between the ink and the exterior of the pen. The corrosive situation is thus rather complex and as the pen should create good writing after some years of storage, the ball must have good corrosion resistance. Furthermore, pen balls must have high hardness in order not to wear when rotating in the seat. The ball material must also be easy to lap during production to make its surface smooth and the diameter within well controlled tolerances. Thus, both strength and toughness is needed for the ball to withstand pressures during lapping.

U.S. Pat. No. 3,503,692 discloses WC—Co cemented carbide or cermets as a material for penballs. In the former case a substoichiometric carbon content is used. In the latter case one or more carbides of Cr, Ta, Nb, W and Ti are bonded together with a nickel or nickel alloy binder phase.

U.S. Pat. No. 3,746,456 discloses a pen ball material consisting of WC or TiC in a binder of Co, Ni, Cr, Pt and Fe.

SUMMARY OF THE INVENTION

A cemented carbide, which fulfils the conditions described above, has been prepared and characterized. The cemented carbide contains tungsten carbide, titanium carbide, nickel, molybdenum and chromium. The composition of the cemented carbide provides good resistance to corrosion as well as a high hardness and wear resistance. These properties are particularly interesting for the manufacture of pen balls, for the ball-point pen balls made with these materials will have steady writing characteristics over a long period of time. This material is particularly suitable when water based inks are used, because these inks are far more corrosive than oil based inks.

Accordingly, a first aspect of this invention provides a cemented carbide ball-point pen ball having, in wt %: 80–90 WC, 5–15 TiC and 7–10 binder phase, which has the following composition, in wt %: 10–60 Ni, 0–30 Co, wherein the total amount of Ni and Co is 40–60, <20 Mo, and 15–40 Cr.

A second aspect of this invention provides a cemented carbide ball-point pen ball consisting of in wt %: 80–90 WC, 5–15 TiC and 7–10 binder phase of the following composition, in wt %: 40–60 Ni, <20 Mo, 15–40 Cr, wherein up to 30 Ni may be replaced by Co.

A further aspect of this invention provides the use of a cemented carbide with composition of, in wt %: 80–90 WC, 5–15 TiC and 7–10 binder phase, which has the following composition, also in wt %: 10–60 Ni, 0–30 Co, wherein the total amount of Ni and Co is 40–60, <20 Mo, 15–40 Cr.

DETAILED DESCRIPTION OF THE INVENTION

Figure 1:
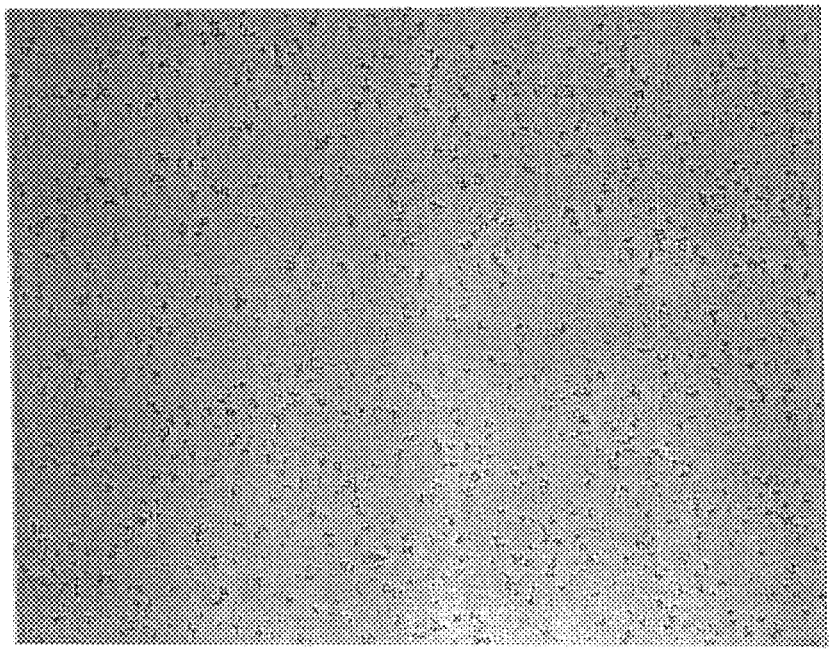
FIG. 1 shows in 200X magnification the microstructure of the cemented carbide according to the invention.
Figure 2:
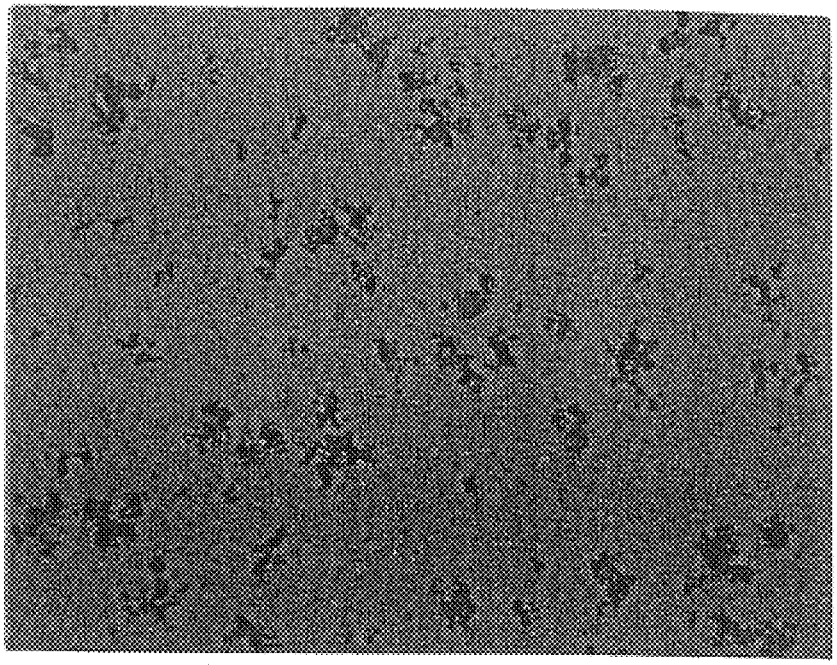
FIG. 2 shows in 1000X magnification the microstructure of the cemented carbide according to the invention.

The cemented carbide according to the invention essentially of, in wt %: 80–90 WC, 5–15 TiC and 7–10 binder phase. The binder phase has the following composition, also in wt-%: 40–60, preferably 45–55 Ni, <20, preferably 10–18 Mo, 15–40, preferably 30–40 Cr. Up to 30 wt % of Ni can be replaced by Co. The grain size of the WC preferably 1–2 $\mu$m. The carbon content preferably low and the cemented carbide should perferably contain 1–10, more preferably 5–7 vol-% $\eta$-phase. The $\eta$-phase should be evenly distributed with an average size of about 5 $\mu$m. The material should have a hardness of 1870–2000 HV and less than A02 porosity. The composition of the ball ensures a high resistance to corrosion. At the same time it has been found that the cemented carbide can easily be shaped into balls of the desired size.

In certain embodiments of the invention the sole components of the cemented carbide are those listed above, along with any normal minor inmpurities.

According to the method of the present invention powders forming the hard constituents and powders forming the binder phase are wet milled together, dried, pressed to bodies of desired shape and sintered. The powder mixture should preferably have such a carbon content to give a carbon content with an $\eta$-phase content of the sintered bodies according to above.

The invention also relates to the use of a cemented carbide with the above mentioned composition as balls for ball point pens.

The invention is additionally illustrated in connection with the following Example which is to be considered to be illustrative of the present invention. It should be understood, however, that the invention is not limited to the specific details of the Example.

EXAMPLE 1

Three cemented carbide bodies with the composition according to the table below, in wt %, were prepared and characterised for their corrosion resistance.

| Sample | 1 invention | 2 prior art | 3 prior art |
|---|---|---|---|
| WC | 83.3 | 84.18 | 85.5 |
| TiC | 8.65 | 0.91 | 0 |
| Co | 0 | 11.1 | 12 |
| Ni | 4 | 0 | 0 |
| Mo | 1.15 | 0 | 0 |
| Cr | 2.9 | 3.3 | 2.5 |
| $d_{WC}$, $\mu$m | 1.2 | 0.8 | 2.5 |

The corrosion resistance of these materials was studied in inks via an electrochemical test intended to simulate the conditions mentioned above. The tests were carried out at 40° C. in the ink to be tested. The experimental device was composed of three electrodes, and the tip of the rotating working electrode was made with the material tested. As some seats are made with brass, some of the tips were also made with brass in order to study the galvanic corrosion between the ball and the seat. The system was allowed to stabilise up to the free potential, and then the system was polarised at 1 mV/s and the value of the current density was recorded. The polarisation resistance of the materials in the inks can be measured with this test. This polarisation resistance is inversely proportional to the current density. The higher the polarisation resistance, the higher the corrosion resistance of the material. The values of the polarisation resistance are found in table below

| Grade | $R_p$ ($\Omega \cdot cm^2$) ink n° 1 | ink n° 2 |
|---|---|---|
| Invention | 400 | 112 |
| Prior art | 450 | 133 |
| Prior art | 50 | 38 |

From the polarisation curves, it is also possible to measure the galvanic coupling between the ball and its seat. For the brass seat and the grades tested, the brass was always the anode, so it is the brass and not the ball, which will be corroded by the galvanic coupling. Thus the cemented carbide of the invention combines good corrosion resistance with high hardness, which is not seen in prior art.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A cemented carbide ball-point pen ball consisting essentially of, in wt %: 80–90 WC, 5–15 TiC, and 7–10 binder phase of a composition, in wt %: 40–60 Ni, 0–30 Co, wherein the total amount of Ni and Co is 40–60, 10–18 Mo, and 15–40 Cr.

2. A cemented carbide ball-point pen ball consisting essentially of, in wt %: 80–90 WC, 5–15 TiC, and 7–10 binder phase of a composition, in wt %: 40–60 Ni, 0–30 Co, wherein the total amount of Ni and Co is 40–60, <20 Mo, and 15–40 Cr, wherein the cemented carbide has 5–7 vol. % of an evenly distributed ηphase.

3. The cemented carbide ball-point pen ball according to claim 2, wherein the η-phase has an average size of about 5 μm.

4. The cemented carbide ball-point pen ball according to claim 2, wherein cemented carbide has a hardness of 1870–2000 HV and a porosity less than AO2.

* * * * *